US006737568B2

(12) United States Patent
Schleske

(10) Patent No.: US 6,737,568 B2
(45) Date of Patent: May 18, 2004

(54) SOUNDBOARD OF COMPOSITE FIBER MATERIAL CONSTRUCTION

(76) Inventor: Martin Schleske, Seitzstrasse 4, 80538 Munich (DE)

( * ) Notice: Subject to any disclaimer, the term of this patent is extended or adjusted under 35 U.S.C. 154(b) by 0 days.

(21) Appl. No.: 09/935,973

(22) Filed: Aug. 23, 2001

(65) Prior Publication Data

US 2002/0069743 A1 Jun. 13, 2002

(30) Foreign Application Priority Data

Aug. 23, 2000 (DE) ..... 100 41 357

(51) Int. Cl.[7] ..... G10D 3/00
(52) U.S. Cl. ..... 84/291; 84/290
(58) Field of Search ..... 84/291, 290, 267, 84/261

(56) References Cited

U.S. PATENT DOCUMENTS 4,969,381 A * 11/1990 Decker et al. ..... 84/291
5,171,926 A * 12/1992 Besnainou et al. ..... 84/275
5,333,527 A * 8/1994 Janes et al. ..... 84/291
5,463,923 A * 11/1995 Kamijyo ..... 84/291
5,469,769 A * 11/1995 Sawada et al. ..... 84/193
5,895,872 A 4/1999 Chase
5,905,219 A 5/1999 Westheimer

FOREIGN PATENT DOCUMENTS

DE 37 38 459 A1 5/1989
EP 0433 430 B1 2/1995

* cited by examiner

*Primary Examiner*—Kimberly Lockett
(74) *Attorney, Agent, or Firm*—John K. McCulloch

(57) ABSTRACT

A soundboard for acoustic musical instruments of the kind in which sound radiation takes place by means of soundboards. A soundboard according to the invention is constructed as a composite fiber sandwich of a core plate and fiber coating. The fiber coating is characterized in that it is multidirectional and single-layer, or multidirectional and applied only to part-zones of the core plate. Because of its more favorable ratio of stiffness to mass relative to the conventional soundboards made from solid wood or composite, the soundboard according to the invention produces an increase in the sound radiation of the musical instrument.

16 Claims, 2 Drawing Sheets

SOUNDBOARD OF COMPOSITE FIBER MATERIAL CONSTRUCTION

Figure 1A:
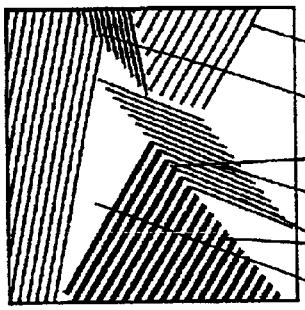

The invention relates to a soundboard of composite fibre material construction for use for an acoustic musical instrument, particularly a bowed stringed instrument.

However, the invention can also be used advantageously for other acoustic musical instruments (such as guitars and pianos) which are provided with a resonant body or resonant back-plate.

BACKGROUND OF THE INVENTION

In recent years attempts have been made to produce the soundboards of acoustic musical instruments in composite fibre material construction. Structures of composite fibre material construction generally consist of long fibres which are preferably oriented in certain directions and a carrier or matrix material which is generally a thermosetting or thermoplastic plastics material. In the preferred embodiment of the invention this is an epoxy resin system.

The previous efforts to produce soundboards of composite fibre material construction intended for acoustic musical instruments are aimed without exception at copying as well as possible the acoustic characteristics of the wood which is to be substituted. Examples of these attempts in the previously known prior art are provided for instance by DE 37 38 459 A1, EP 0 433 430 B1, U.S. Pat. Nos. 5,895,872 and 5,905,219. Thus DE 37 38 459 A1 aims at "a macroscopic heterogeneity almost equal to the wood" and states as the object that "the composite material" should "have similar characteristics to spruce".

An unsatisfactory feature of these previously known soundboards of composite fibre material construction appears to be that from the acoustic point of view they are equivalent but in no way superior to very good solid wood soundboards of traditional construction.

The object of the invention, therefore, is to create a soundboard of composite fibre material construction which has a perceptibly better acoustic quality by comparison with excellent soundboards of traditional construction. In particular the soundboard according to the invention should have substantially higher radiated power whilst retaining the usual and desirable timbre of a solid wood soundboard.

This object is achieved according to the invention by the provision of a soundboard formed by a fibre coating of single-layer and at the same time multidirectional construction.

SUMMARY OF THE INVENTION

In detail, the invention is based on the following considerations and tests:

The cause of the sound radiation of the instrument is its characteristic vibrations. The frequencies and mode shapes of the eigenmodes of vibration crucially determine the timbre of the instrument. The formation of the eigenmodes of vibrations is again dependent upon certain material properties, amongst which the anisotropy of the wood is of outstanding importance. Anisotropy is understood to mean the directionality depending upon the physical properties of a material. The anisotropy of the velocity of sound of the longitudinal waves, i.e. the ratio of velocity of sound in the longitudinal direction to velocity of sound in the cross direction of the run of the fibres, is approximately 4:1 in the case of spruce wood and is thus very pronounced. The velocity of sound in the fibre direction which is approximately four times as great as the velocity of sound across the fibre may be attributed to the higher longitudinal bending strength of the spruce wood. The high stiffness in the longitudinal direction of the fibre also appears sensible because of the great forces occurring in this direction (because of the string tension).

Furthermore, in the conventional bowed stringed instrument there is a very good conformity between the anisotropy of the velocity of sound and the outline proportions (length to width) dictated by playing techniques, which are likewise of the order of magnitude of 4:1.

For these reasons it is necessary for the anisotropy of the soundboard produced from composite fibre material to correspond to the anisotropy of the conventional soundboard produced from solid wood. Otherwise the requirement to retain characteristic frequencies and characteristic vibrational shapes (and thus the desired and required timbre) is not met.

It might be thought that the required anisotropy could be produced by positioning various unidirectional layered fibre structures at certain angles crosswise one above the other and applying them to both sides of the core plate. The usual procedure is to build up a composite fibre structure in this way from stacked laminate layers when the object is to adapt the physical properties of the structure to the loading directions of the component. The angles which the longitudinal directions of the fibres of the various unidirectional layers of fibres assume with respect to one another then determine the ration of longitudinal stiffness to cross stiffness [see: Michaeli/Huybrechts/Wegener: "Dimensionieren mit Faserverbund-kunststoffen", Munich, Vienna 1994, page 61]. The previous attempts at producing soundboards from composite fibre materials follow this usual procedure. They are always built up from a more or less great number of different layered fibre structures or fibre meshes laid one above the other (laminates). cf. for instance DE 3737459, DE 69023318 T2; U.S. Pat. Nos. 5,955,688 or 6,087,568. All of these attempts rightly take account of the fact that the use of one single unidirectional layer of fibres on each side of the core plate is not as a rule sufficient to produce the required anisotropy. On the other hand, these conventional approaches to a solution underestimate an acoustically essential property of soundboards:

The vibration levels of the characteristic vibrations are crucial for the sound radiation of the instrument. They are dependent upon the vibrating mass of the soundboard, the acoustic significance of which results from the following correlation: The vibration resistance (so-called impedance) which the soundboard opposes to the exciting alternating force generated by the string vibrations is greater the higher the vibrating mass of the soundboard is. In order to achieve high vibrating speeds (so-called velocity) of the soundboard and thus the most effective possible sound radiation of the instrument, with a given excitation force the lowest possible vibration resistance and thus the lowest possible vibrating mass are necessary.

Since in the case of composite fibre sandwich constructions the predominant proportion of the total mass is provided not by the core plate but by the fibre coating, the total mass depends above all on the number of composite fibre coatings which is necessary.

This is apparent—by way of example for a violin—from the following numerical example: The average total mass of a conventional violin top plate made from spruce wood is between 60 and 75 grams. Soundboards having the same geometry and made from composite fibre material provide the following total masses, depending upon the number of fibre coatings applied (in the case of fibre coatings with a weight per unit area of 100 g/m$^2$):

With one fibre coating in each case on the upper and lower face of the core plate: 46 grams total mass of the soundboard.

With two fibre coatings in each case on the upper and lower face of the core plate: 68 grams total mass of the soundboard.

With three fibre coatings in each case on the upper and lower face of the core plate: 91 grams total mass of the soundboard.

Thus it is clear that already with the use of only two unidirectional fibre coatings per face of the core plate, and thus the minimum number of fibre coatings necessary in order to produce the anisotropy, there are no longer any acoustic advantages over the conventional spruce soundboard.

With these considerations as a starting point, therefore, the invention follows a fundamentally different route in order to the anisotropy of the soundboard of composite fibre material construction in the required manner.

Whereas in the previous attempts at solutions for producing soundboards as a composite fibre sandwich the core plate is completely coated with a more or less large number of layers of fibres lying crosswise one above the other, in the solution according to the invention the multidirectional fibre alignment is achieved by means of a single-layer fibre coating or only part-zones of the core plate are provided with a fibre coating. Depending upon the fibre layer pattern the individual zones of the plate acquire different stiffness ratios between the longitudinal stiffness and the cross stiffness due to the degree and frequency of the changes in fibre direction.

The requirement for a single-layer and at the same time multidirectional fibre coating defines a layered fibre structure which in one single layer changes its fibre direction. In this case the fibres of individual fibre groups extend in the same direction, that is to say they are oriented as if "combed". Thus this is not a tangled fibre layer in which the fibres are likewise disposed multidirectionally; whereas in the tangled fibre coating the individual fibres are "mixed up together", that is to say disposed randomly, in the fibre coating according to the invention due to the "combed" arrangement as fibre groups the individual fibres form common linear fibre patterns. In contrast to the tangled fibre coating in which the individual fibres overlap at any angles, because of the "combed" fibre orientation in the fibre coating according to the invention possible overlaps predominantly have small angles between individual fibres.

The term "single-layer" does not exclude the possibility that individual fibres can be superimposed on one another to a certain extent because of their small cross-section within the matrix system in which they are embedded. Such superimposition of fibres of a single-layer fibre coating cannot be avoided as a rule using manufacturing techniques—even when using prepregs—since during the liquefaction phase of the matrix system up to its ultimate hardening the fibres have a certain freedom of movement. Rather, the term "single-layer" provides a definition which excludes the provision of a multi-layer construction such as is given in the conventional crosswise and/or layered construction by a plurality of fibre coatings or fibre meshes lying one above the other.

The reduced number of fibre layers according to the invention (with simultaneous production of the required anisotropy due to the changes in direction of the fibre coating) permits the production of substantially lighter soundboards by contrast with the prior art. Since, as explained, the vibrating mass of the soundboard is inversely proportional to the achievable speed of vibration (velocity), the solution according to the invention provides a higher sound radiation by contrast with the previous soundboards of composite fibre material construction and by contrast with the conventional solid wood soundboards with the same anisotropy and thus the same timbre.

Thus the soundboard according to the invention enables instruments to be built which correspond to the conventional instruments made from solid wood as regards the hearing habits (sensing the timbre) but which are markedly superior to the traditional instruments as regards their acoustic efficiency.

THE DRAWINGS

Figure 2:
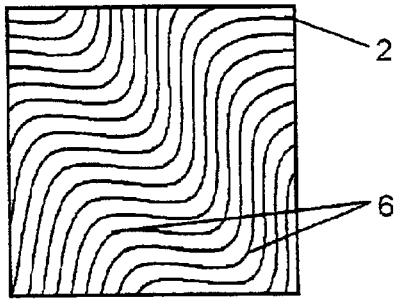
Figure 3:
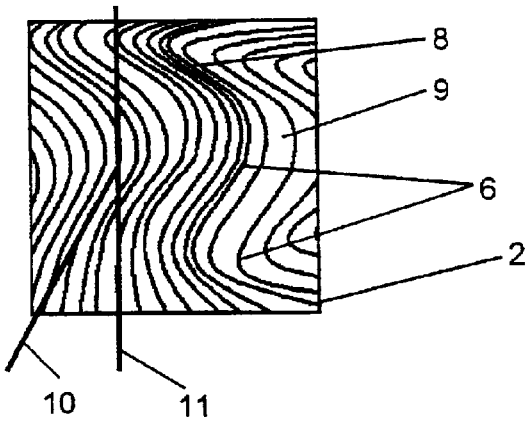
Figure 4:
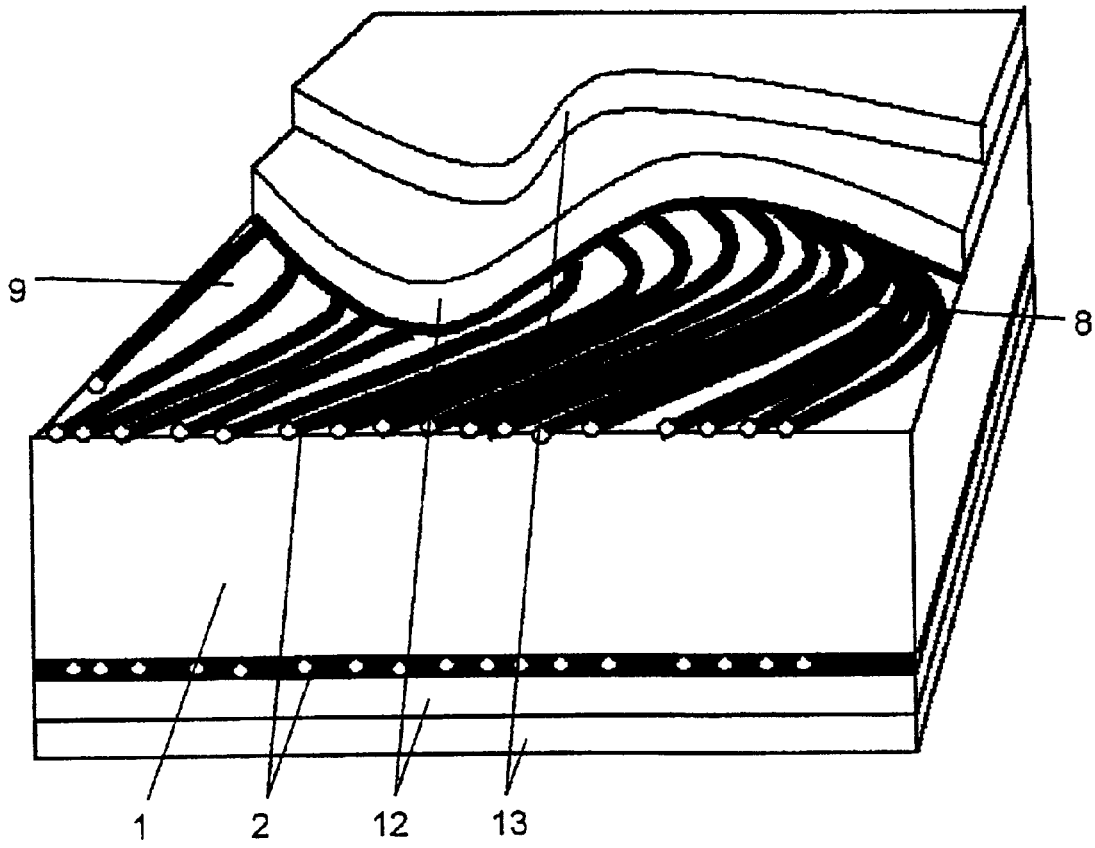

Preferred embodiments of the invention are shown in the accompanying drawings wherein:

FIGS. 1*a*, 1*b*, 2, and 3 are diagrammatic views illustrating a core plate on which coatings of fibres are applied; and FIG. 4 is an isometric view of a core plate sandwiched between multiple layers of fibre coatings.

DETAILED DESCRIPTION

The fibre coating according to the invention can basically be produced by various methods. One possibility is offered by the hand lay-up lamination of the core plate. Whilst this method only requires a small investment, it is very time-intensive for this and less reproducible than other methods. Therefore, an alternative method, namely the production of a so-called prepreg (pre-impregnated fibres) also is disclosed. A prepreg constitutes a semifinished product which is pre-impregnated with usually thermoplastic or thermosetting carrier material (matrix). It offers the advantage that the very complex operation of impregnation of the fibres with the matrix resin is carried out separately from the actual coating of the core plate. This operation is very important for the quality and the characteristics profile of the subsequent composite fibre material and is carried out on a prepreg system under controlled and reproducible conditions [see Ehrenstein, G. W.: "Faserverbund-Kunststoffe", Munich-Vienna 1992]. Although textile layer structures and meshes of the most varied forms are offered as prepregs, they do not have the features of the invention. In the past multidirectional prepregs have always been built up as a crosswise mesh or as a combination of several unidirectional laminates. Thus they have a higher weight per unit area, which is disadvantageous in the manner referred to, than the multidirectional and at the same time single-layer fibre coating according to the invention.

In individual cases, namely when the soundboard is used for musical instruments in which the static loading due to the string tension acting on them is such that part-zones of the soundboard are subjected to no or only very slight static loads, it is advantageous to reduce the vibrating mass of the soundboard in that no composite fibre coating is provided in these part-zones. Thus in this case only those part-zones of the core plate which are subjected to strong static loads are provided with the strengthening fibre coating.

In the part-zones which are not coated with composite fibre material the physical properties of the soundboard, particularly in the case of the preferred use of balsa wood as core plate material, are provided by the core plate itself. Furthermore, a thin layer of solid wood (preferably of spruce or maple wood) which takes up the total area of the soundboard preferably applied to each face of the core plate in order additionally to increase the total bending strength of the plate in the zones of the plate which are not provided with composite fibre material. Since particularly in the case of the preferred use of carbon fibres the fibre coating has a very high density, due to the partial coating, a considerable saving is made on the vibrating mass and thus the sound radiation of the soundboard according to the invention is substantially increased.

When the soundboard according to the invention is used for musical instruments in which the soundboard is subjected to strong static loads in part-zones (as the case with bowed stringed instruments for instance in the top plate zone below the fingerboard) it is provided that the multidirectional fibre coating is of multi-layer construction in the said part-zones which are subjected to strong static loading. The associated (and in fact unwanted) increase in the vibrating mass is compensated for by the feature of only partial composite fibre lamination of the core plate 1.

Figure 1B:
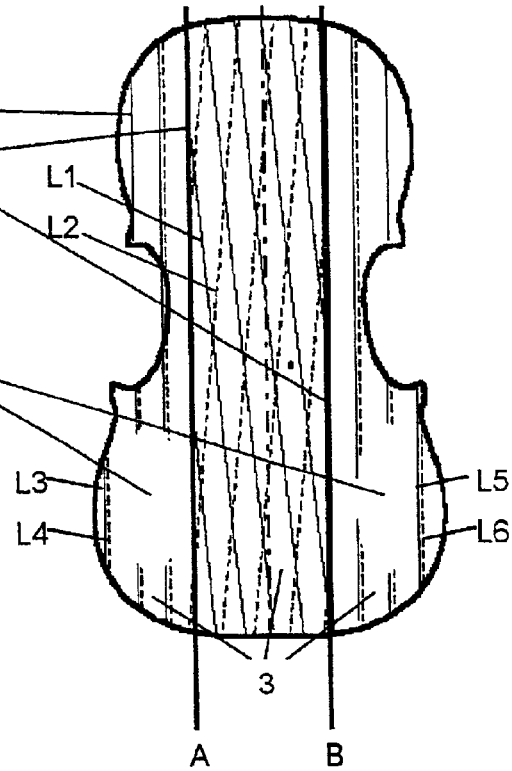

The changes in direction 6 of the fibres 2 of the multidirectional run of the fibres are shown in FIGS. 1 to 3. These changes in direction can be abrupt, as can be seen in FIG. 1*a*. This is the case when the fibre coating takes the form of individual strips 3 or individual zones 4 which are separated from one another by gaps. In part-zones 5 the fibre coating is cut away so that the fibre coating 2 is provided only on at least one part-zone of the core plate 1. Fibre characteristics, such as thread fineness or thread thickness, are variable over the total area of the fibre coating (cf. in FIG. 1*a* the differing fibres denoted by 7 in two zones).

The variant according to FIG. 1*a* shows a segment of the area of the fibre coating according to the invention which consists of a plurality of individual zones 4 (unidirectional in the illustrated example) which are separated from one another and are applied in patchwork fashion to the core plate. The individual zones considered by themselves do in fact have a unidirectional run of the fibres. However, the longitudinal directions of the fibres of the zones 4 take up different angles with respect to a common reference axis. In this way a multidirectional, single-layer fibre coating is produced in the fibre coating as a whole.

As an alternative to this, FIG. 1*b* shows—using the example of a variant of the invention for use for bowed stringed instruments—the creation of the single-layer multidirectional fibre coating by individual differently oriented strips 3 (which are unidirectional in the illustrated embodiment) which, depending upon position, are designated by L1 to L6*a* and take up larger part-zones of the total area. The fibre coating of the upper face is designated by L1, L3 and L5 (solid lines) and that of the lower face is designated by L2, L4 and L6 (broken lines). The run of the fibres in the upper face differs from the run of the fibres of the lower face. This is the case in the illustrated embodiment with the fibre coating L1 and L2 (in the central zone between the lines A and B), whereas the run of the fibres in the edge zones (to the left of line A and to the right of line B) on the upper face (L3 and L5) is identical to the run of the fibres on the lower face (14 and L6). At the boundary edges A and B of the strip there is a change in the fibre direction 6: The central strips L1 and L2 (Between the lines A and B) show an angular deviation from the longitudinal direction of the soundboard, whilst the strips in the edge region L3 to L6 are oriented parallel to the longitudinal direction. In this way in the illustrated variant the multidirectional fibre coating is produced by the differing fibre orientation of the central zone and the edge zones. A "stopping" effect, i.e. a stiffening in the cross direction, is achieved in this case in the central part, and in fact is achieved not by the conventional crosswise layered construction of several laminates but by the deviation between the run of the fibres on the upper face and the run on the lower face of the core plate 1. The upper face and the lower face of the core plate are always provided in all zones only with one single-layer fibre coating. At the boundary edges of the differently oriented strips 3 or zones 4, overlaps due to production techniques are permitted and provided. As in the example according to FIG. 1, part-zones 5 of the soundboard are also not covered with fibres in the variant according to FIG. 1*b*.

The preferred embodiment does not have any abrupt changes of direction, but rather, as shown in FIGS. 1 and 3, it has continuous changes in direction 6. Not only in this case but also in the case of the abrupt changes in direction of the fibres shown in FIG. 1, the fibre zones are oriented as if they have been "combed", and thus the individual fibres form a common fibre pattern. In this case the fibre coating has different proportions of fibres per unit area, as is shown in FIG. 3 by zones 8 of increased fibre density (proportion of fibres per unit area) and zones 9 of reduced fibre density. As a result the mass coverage (mass per unit area) and physical properties can be better adapted to the loading directions and characteristic vibrational shapes of the soundboard than is the case with a constant fibre density.

Due to the multiple changes in direction of the fibres a "stopping" effect is produced in such a way that a stiffening proportion of the fibre coating is also achieved transversely with respect to the longitudinal direction of the soundboard. This stopping effect, which is illustrated in FIG. 3 at a point for example through the run of the fibres (direction of the line 10) which deviates from the longitudinal direction (direction of the line 11) of the soundboard, is provided in the preferred embodiment of the soundboard. As a result the cross stiffness of the soundboard is increased deliberately on some zones.

Also in the embodiments with continuous changes in direction S (FIGS. 2 and 3) it may be advantageous that the run of the fibres on the upper face deviates from the rim of the fibres on the lower face of the core plate.

In order when using carbon fibres, which are only slightly damped and therefore sound rather metallic, to produce a damping range of the characteristic vibrations which corresponds to the "warm" sound of wood, a preferred embodiment of the invention has at least one thin damping layer in at least one part-zone of the total area of the soundboard. A thin outer layer of solid wood, which by preparation or priming and varnishing contributes substantially thereto, is preferably additionally applied to each of the surfaces of the soundboard in order to produce the required damping values of the soundboard. The construction of a segment of the area of the preferred embodiment of the invention is shown in FIG. 4: it consists of the core plate 1, multidirectional and at the same time single-layer fibre coating 2 (with zones of increased fibre density 8 and zones of reduced fibre density 9), as well as the damping layer 12 and the outer layer 13 of solid wood. In order to make the run of the fibres distinguishable, in FIGS. 1 to 4 the fibre density (proportion of fibres per unit area) is shown markedly smaller and the fibre diameter is shown markedly larger than is actually the case in the preferred embodiment of the invention.

I claim:

1. A soundboard for an acoustic musical instrument comprising a core plate having two opposite faces and a plurality of single layer fibre coating sections adhered on at least one of the faces of said core plate, each of said fibre coating sections being composed of elongate fibres embedded in a carrier, the fibres of each of said coating sections being so arranged as to be multidirectional.

2. The soundboard according to claim 1 wherein in at least one of said coating sections the distribution of fibres per twit area varies.

3. The soundboard according to claim 1 wherein at least some of the fibres in at least some of said coating sections have direction changes.

4. The soundboard according to claim 1 wherein the fibres in at least some of said coating sections are arranged in groups extending in a similar direction.

5. The soundboard according to claim 1 wherein the coating sections are in the form of strips.

6. The soundboard according to claim 5 wherein at least some of the strips are separated from one another by gaps.

7. The soundboard according to claim 1 wherein the fibres of at least some of said sections have varying thicknesses.

8. The soundboard of claim 1 including a plurality of said fibre coating sections adhered on each of said faces of said core plate.

9. The soundboard according to claim 8 wherein the direction in which the fibres in the sections on one face of said core plate extend is different from the direction in which the fibres in the sections on the other face of said core plate extend.

10. The soundboard according to claim 1 including a damping layer provided on said core plate in at least one zone thereof.

11. For use in an acoustic musical instrument of the kind having two soundboards of a resonant body of a bowed stringed instrument, at least one of said soundboards comprising a core plate having two opposite faces, and a plurality of fibre coating sections each of which has elongate fibres embedded in a carrier, said sections being adhered to one of said faces of said core plate, at least some of said sections being spaced by gaps from others thereof.

12. A soundboard for use in an acoustic musical instrument, said soundboard comprising a core plate sandwiched between and adhered to fibre coating sections, each of said coating sections having a plurality of elongate fibres embedded in a carrier, said coating sections being arranged on said core plate in such manner that the fibres of at least some of said sections are multidirectional, at least some of said sections on at least one face of said core plate being spaced apart by gaps.

13. The soundboard according to claim 12 wherein said sections are in the form of strips.

14. The soundboard according to claim 13 wherein the strips on one face of said core plate are arranged differently from the strips on the opposite face said core plate.

15. A soundboard for an acoustic musical instrument comprising a core plate having two opposite faces and a plurality of single layer fibre coating sections in the form of strips adhered on at least one of the faces of said core plate, each of maid fibre coating sections being composed of elongate fibres embedded in a carrier, the fibres of each of said coating sections being so arranged as to be multidirectional.

16. The soundboard according to claim 15 wherein at least some of the strips are separated from one another by gaps.

* * * * *